US009409638B2

(12) United States Patent
Salas Garcia

(10) Patent No.: US 9,409,638 B2
(45) Date of Patent: Aug. 9, 2016

(54) METRORÍO SYSTEM FOR REGULAR TRANSPORT OF URBAN AND INTERURBAN PASSENGERS BY RIVER AND SEA

(71) Applicant: Augustin Javier Salas Garcia, Coria Del Rio (ES)

(72) Inventor: Augustin Javier Salas Garcia, Coria Del Rio (ES)

( * ) Notice: Subject to any disclaimer, the term of this patent is extended or adjusted under 35 U.S.C. 154(b) by 0 days.

(21) Appl. No.: 14/361,591

(22) PCT Filed: Nov. 29, 2012

(86) PCT No.: PCT/ES2012/000302
§ 371 (c)(1),
(2) Date: Aug. 6, 2014

(87) PCT Pub. No.: WO2013/083862
PCT Pub. Date: Jun. 13, 2013

(65) Prior Publication Data

US 2014/0348592 A1 Nov. 27, 2014

(30) Foreign Application Priority Data

Dec. 7, 2011 (ES) ..... 20110334

(51) Int. Cl.

| | |
|---|---|
| ***B63C 1/04*** | (2006.01) |
| ***B63B 27/00*** | (2006.01) |
| ***B63B 29/00*** | (2006.01) |
| ***B63B 35/00*** | (2006.01) |
| ***E03F 11/00*** | (2006.01) |
| ***E01D 15/24*** | (2006.01) |
| ***E04F 11/00*** | (2006.01) |
| ***E02B 3/20*** | (2006.01) |
| *B63B 27/14* | (2006.01) |

(52) U.S. Cl.
CPC . *B63C 1/04* (2013.01); *B63B 27/00* (2013.01); *B63B 29/00* (2013.01); *B63B 35/00* (2013.01); *E01D 15/24* (2013.01); *E02B 3/20* (2013.01); *E04F 11/002* (2013.01); *B63B 27/14* (2013.01); *B63B 2035/002* (2013.01); *B63B 2035/004* (2013.01)

(58) Field of Classification Search
CPC ..... B63C 1/04; B63B 29/00; B63B 35/00; B63B 27/00; B63B 2035/002; B63B 2035/004; E04F 11/002
USPC ..... 405/218, 219
See application file for complete search history.

(56) References Cited

U.S. PATENT DOCUMENTS

| | | | | |
|---|---|---|---|---|
| 2,879,735 | A | 3/1959 | Pointer | |
| 8,419,315 | B2 * | 4/2013 | Grimont | 405/195.1 |
| 8,434,968 | B2 * | 5/2013 | Birkeland | 405/210 |

(Continued)

FOREIGN PATENT DOCUMENTS

| | | |
|---|---|---|
| DE | 19616864 | 11/1997 |
| ES | 2025753 | 4/1992 |

(Continued)

*Primary Examiner* — Tara M. Pinnock
(74) *Attorney, Agent, or Firm* — Preston Smirman; Smirman IP Law, PLLC

(57) ABSTRACT

A rivertube system for transporting urban and metropolitan passengers by river and sea using watercraft, with the watercraft travelling along the rivers and coasts of cities. The system includes an automatic docking system for boats and closed or covered stops, built on the river or on the sea, with large floating platforms that enable passengers to get on and off the boats.

2 Claims, 4 Drawing Sheets

(56) References Cited

U.S. PATENT DOCUMENTS

Figure 1:
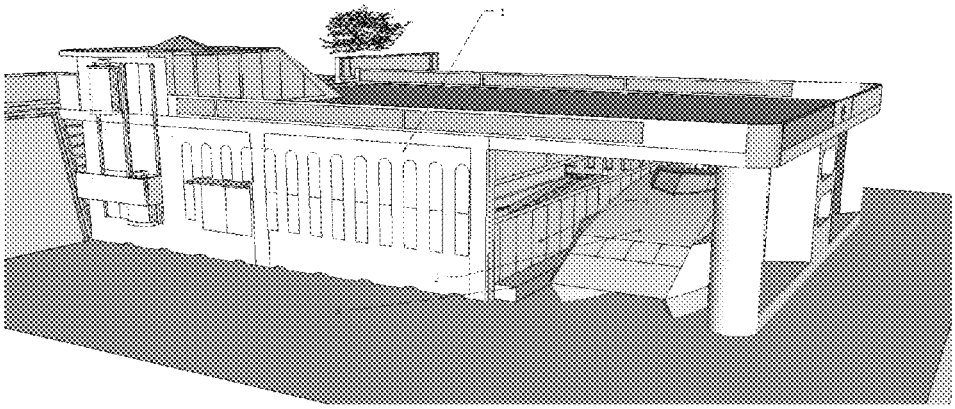

| | | | | |
|---|---|---|---|---|
| 2003/0056708 | A1 | 3/2003 | Vollmerhausen | |
| 2007/0044702 | A1 | 3/2007 | Waldock | |
| 2009/0114769 | A1 * | 5/2009 | Campbell ..... | 244/114 R |

FOREIGN PATENT DOCUMENTS

| | | |
|---|---|---|
| GB | 2080228 | 2/1982 |
| WO | 0168442 | 9/2001 |
| WO | 2007093775 | 8/2007 |

* cited by examiner

METRORÍO SYSTEM FOR REGULAR TRANSPORT OF URBAN AND INTERURBAN PASSENGERS BY RIVER AND SEA

CROSS-REFERENCE TO RELATED APPLICATION

The instant application is a national phase of PCT International Application No. PCT/ES2012/000302, filed Nov. 29, 2012, and claims priority to Spanish Patent Application Serial No. P201101334, filed Dec. 7, 2011, the entire specification of both of which are expressly incorporated herein by reference.

TECHNICAL SECTOR

The invention belongs to the sector of regular passengers transport.

TECHNICAL STAND

Currently, the most efficient systems of passenger's public transport in the big cities are the underground systems and mixed systems (underground and exterior), for the reason that they get circulation ways reserved to the traffic, without traffic jam or hold-up. They are trains with high capacity for users with a high frequency. This reliability, together with the great quality of the stations and of the modern trains has as a consequence that this is the most used transport method in the cities where they are established.

The main disadvantage of the system is the enormous investment required to generate the necessary infrastructures to get the system into operation, as well as the high costs of maintenance. It is necessary to drill dozens of kilometers of subterranean tunnels, excavate and construct dozens of underground stations. Besides, the acquisition of expensive train wagons, with complicated machinery, security systems, ventilation, kilometers of railways, kilometers of catenaries and dozens of electrical supply sub-stations. These systems can require the investment of more than 1.000 millions Euros for each 20 km of the line.

The system of tube by railway is sufficiently developed and standardized, so that any important city risks making this enormous investment in projects of high complexity with a high security of success.

A solution which would give the same service, using already existent fluvial lanes in many of the big cities in the world would be an improvement that would save 90% of the necessary investment.

The present invention targets on developing an industrial transport system for passengers using the fluvial lanes of big cities with the reliability, quality and efficiency of the transport of the underground tube. The system would be used in cities like London, Paris, Seville, New York, etc. The majority of the big cities have grown beside rivers or the sea.

Currently, there exist innumerable fluvial transport systems for persons but none of them propose an efficient, reliable and high quality system similar to the underground tubes. There are used ferries and standard boats, with conventional docking systems, that need more than one worker to tie ropes, to dock the boat to the quay and to open the gangway for the exchange of passengers. They use piers at open air which do no guarantee a docking time, exchange of passengers and departures similar to the stop system of the current tubes.

Almost all cities exploit their fluvial lanes, but in the way of conventional ferries. For example, the ferries' lines City Cat in Brisbane, Australia; Water Taxis, East River Ferries, Hudson River Ferries or Beldford River Ferry in New York; Macao TurboJet Lines. Most of them are long distance lines and with little frequency or they are mainly used by tourists because of their slow operations.

DETAILED DESCRIPTION OF THE INVENTION

The present invention refers to a system of urban and interurban tube that uses the fluvial lanes available in many of the big cities of the world to reduce the necessary investment to 90% without disminishing the quality, efficiency and reliability of the transport's system. The new transport's system, that we will call from now on RiverTube, requires a number of inventions and modifications of the current tube model, that altogether represent a novel invention and repeatable, like a perfectly modeled industrial exploitation of the fluvial and sea lanes of the big cities and non-existent at present.

The system RiverTube proposes the following changes and modifications to the current concept of tube and of the passenger's transport by boat:

- The existent fluvial lanes of the city will be used, instead of creating new and expensive infrastructures, and the sea for those coast cities that allow it (or mixed systems) making a massive, efficient and secure exploitation at the same level of an underground tube.
- There will be used boats (catamarans) instead of a set of trains. For the fluvial use, the catamarans will be light and economic. It is not necessary to make investments in railways, catenaries, electric sub-stations nor subterranean tunnels.
- The catamarans will have electric motors as a propulsion system, but to eliminate the investment of the catenaries, they will use a system of interchangeables batteries. The batteries will be charged in the central stations and they will be interchanged to the boat when its batteries are unloaded. This process will take place in seconds, without slowing down the normal operation of the boat. The catamarans will be provided with solar panels, wind generators and other systems that supply the autonomy of the boat.
- The catamarans will be provided with an additional platform for the bicycle transport. This, together with its wide automatic doors, will allow the bicycle transport even in rush hours.
- The catamarans will have one or two floors, depending on the requirements of the line, the height and disposition of the bridges and the barriers to be avoided in the navigation lane. The size of the catamaran and the number of persons that can be transported will be determined by each implementation of the model.
- The passing frequency by the stations will depend on the concrete line, but it should be inferior than 6 minutes in rush hour and inferior than 12 minutes at normal times.
- The catamarans will have available an automatic docking system that reduces the necessary time for the stop and exchange of passengers in less than one minute, similar to the stop times of the modern tubes. The automatic docking system is the main invention of the model that allows making the stop in seconds and that reduces the number of required workers to only the boat pilot. The automatic docking system is one of the claims of the application of the present patent and involves the development of some inventions in the boat and at the quay.
- The docking system will have a set of automatic doors in the quay and in the boat that will open simultaneously and coordinately to avoid accidents and the fall of users into the water. The doors will have large dimensions to facilitate the exchange of passengers, baby strollers, wheel chairs and bicycles, even in rush hours.

The catamarans will have a special design that minimizes the generation of waves to avoid the damages at the banks of the river lanes and to benefit the recreational and private use of the fluvial lane. The system foresees the creation of reserved canals to the traffic of the RiverTube in the fluvial lanes through the construction of walls that separate the traffic and isolate the waves.

There will be installed control systems of Maritime and Fluvial Traffic VTS (definition of IALA) that will use radars, AIS systems (Automatic Information System) and surveillance cameras to locate and control all the boats in the fluvial lanes. These systems will be used to provide information to the information system for the passenger that will be available in all stops and boats. There will be installed a system of communications TETRA (Terrestrail Trunked Radio) to allow the pilots, workers and boats to communicate with the control and operations centre.

There will be installed navigation simulators with the boat models and the scene of the fluvial and maritime lanes for the continuous training of the pilots and workers.

The ticket's systems will be provided of transport titles with a magnetic band without standard contact and will have printed a QR code for the access to the services of on-line payment and recharge of the transport titles.

Figure 2:
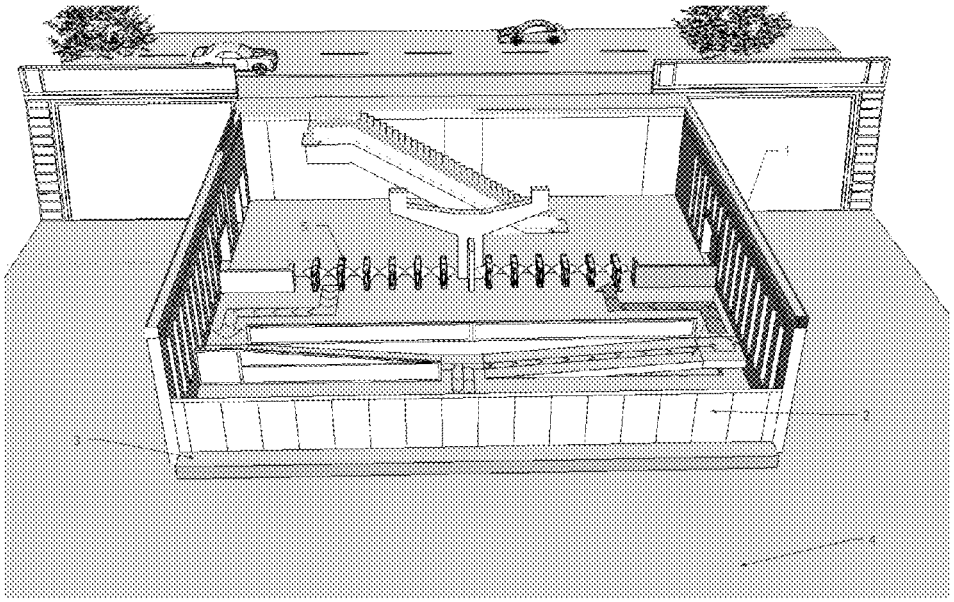
Figure 3:
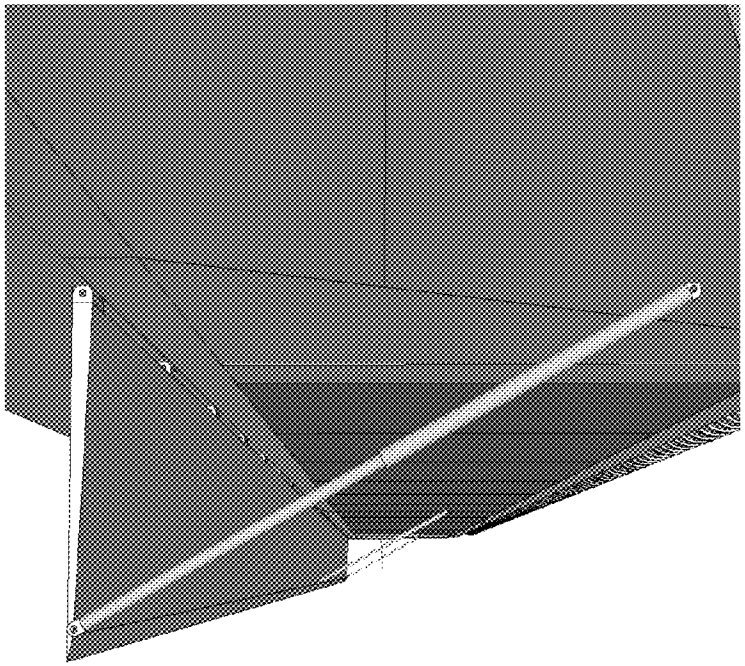
Figure 4:
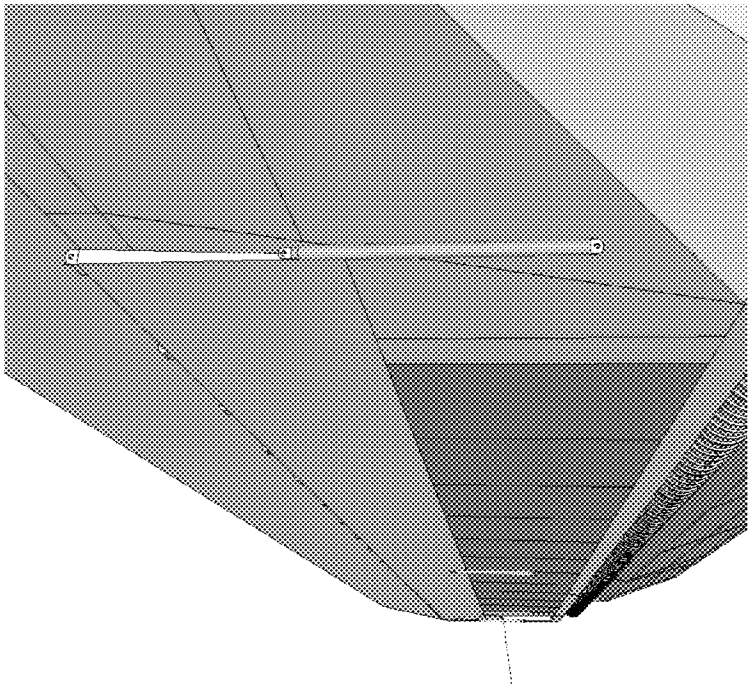
Figure 5:
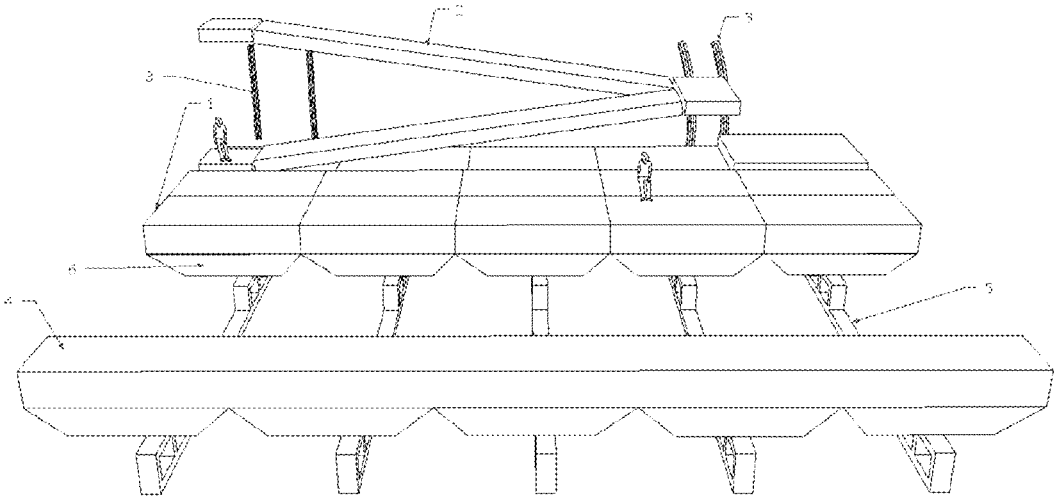

Referring generally to the FIGS., the stops 1 (e.g., see FIGS. 1,2 and 5) will be closed buildings with access to a floating quay 3 (e.g., see FIGS. 1-3, 5 and 7) through mobile ramps 6 that correct the height's difference of the water level 4 (e.g., see FIG. 2 by consequence of the tide or controlled changes of the level through locks. The boat 2 (e.g., see FIGS. 1-4, 6 and 7) will enter the building and there will be an exchange of passengers, after the opening of the automatic doors 7 (e.g., see FIGS. 1-2, 6 and 7) of the quay 3 (e.g., see FIGS. 1-3, 5 and 7), as if it was a subterranean station. This is a fundamental improvement of the current transport system by boats together with the automatic docking, that makes the system similar to the subterranean tube. The ticket processing devices 5 (e.g., see FIG. 2) provided in the station guarantee that the cancellation of the ticket will be made before passengers get on the boat and improves the agility of the exchange of passengers.

The floating quay will have large dimensions to guarantee the access of a high number of persons that can get on and off the boat.

The location of the stops will be provided according to a previous study of mobility, being recommended to place it near the bridges and walkways to bring nearer both banks of the river in the case of fluvial lanes. It is recommended also to provide the stations near the current conventional tube stations, bus stations or cycle paths.

The metropolitan stops or exterior stops to the city will be provided with extensive dissuasive parking to attract the users that come by car from their towns not near to the river and so avoid the massive entrance in the centre of the big cities. The mobility analysis, which will be carried out before the implantation of the model, will determine the modifications that have to be made in the current transport system, like the bus lines, to bring the passengers to the stops and to relieve pressure in the urban traffic.

Figure 6:
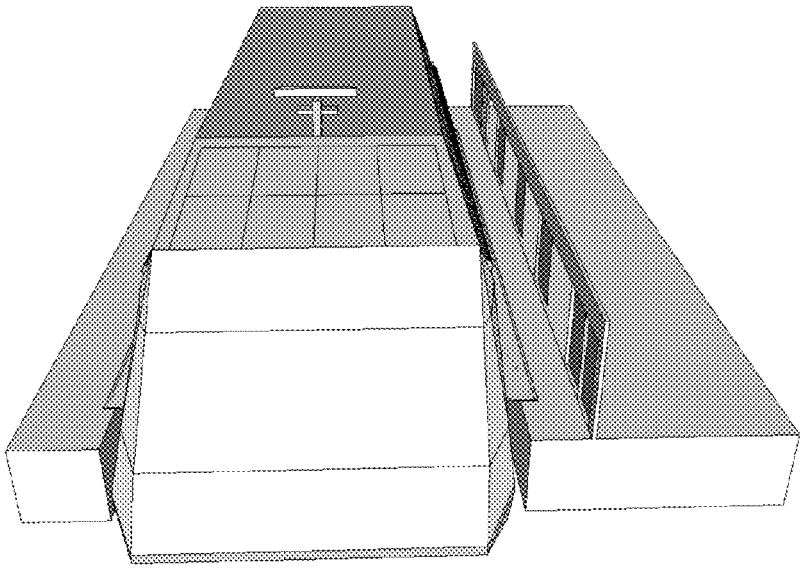
Figure 7:
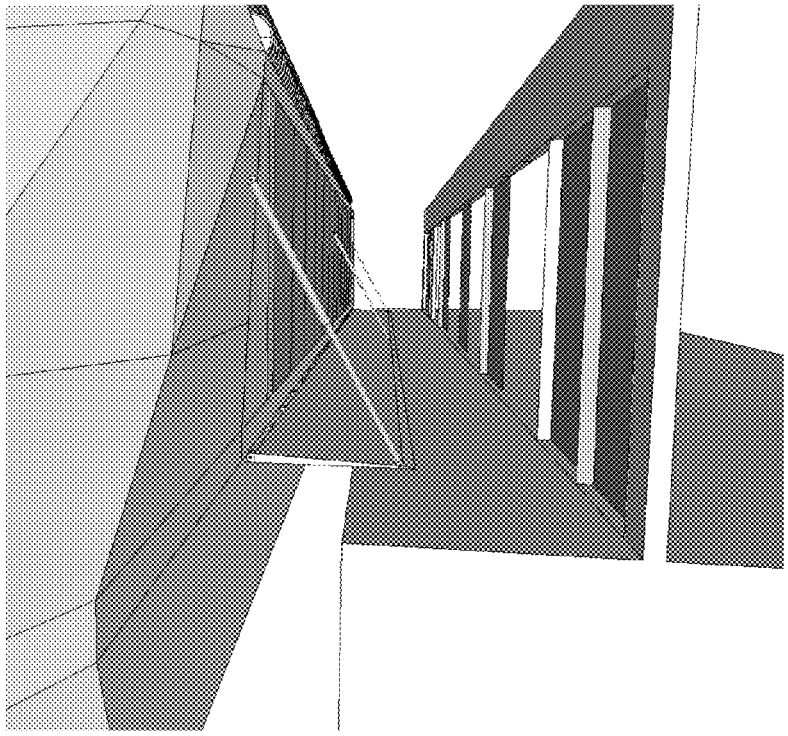

Referring specifically to FIGS. 6 and 7, the automatic doors 7, 8, at the quay 3 and at the boat 2, respectively, can be the type of vertical opening, which would provide a door's width of almost the whole length of the boat and would improve the efficiency of the passengers' exchange with respect to a subterranean tube, in which the users must first go out through narrow doors before the new users can get in.

As follows we will describe an example of use of the system with a study carried out for the city of Seville. The Guadalquivir river, flowing through Seville has two arms: the alive canal that flows from the north to the south at the west side of Seville, bordering the lands of Expo'92, Triana, Los Remedios and the commercial harbor; the inner basin (it is a lake of controlled level), closed to the north by the buffer of El Alamillo and to the south by the new lock. Both canals represent a navigation lane free of jams to cross Seville from north to south passing through the historical center and the most important neighborhoods, unifying all the towns at the river and El Aljarafe with the capital. The exterior canal can have strong tides and can be subject of the effect of the tides. Its level can fluctuate until 3,5 meters high, while the basin is more stable and has no stream flows. In the attached documentation we render a presentation with the designed implementation for this city. In this case, there will be used catamarans with an useful surface of 20×8 square meters with a charge of 250 passengers in two floors. There are available 112 seats and a platform for 30 bicycles. There will be created 4 lines with 22 stops that will connect almost 40 kilometers. There will be required 25 boats to maintain a frequency of 6 minutes per stop in rush hour and 12 minutes in normal times (the rush hours will be from 7:30 to 9:30 and from 13:30 to 15:30). The ticket's price will be exactly the same as in the current urban tube and will be integrated in the charging system of the Consortium of Transports of Seville. The quays will have an useful surface of the main float of 25×6 square meters, a docking canal of 8,30 meters and a float of 25×2 square meters for the automatic docking system. The quay will operate with until 4 meters differences in the water level. It is planned the construction of a separated canal of 3 kms. at the inner basin to allow the private use of the river and not to interfere in the rowing centre of high performance. This canal will be built between the Alamillo bridge and the walkway of La Barqueta. It will be built like a concrete wall of 3 meters depth on piles, with two meters under water and one meter above the surface in its middle level. There are planned two modal transport exchangers at each end of the inner basin (south lock, north buffer of Alamillo). There will be 12 stops in the centre of Seville and another 10 stops in the towns at the river. All exterior stops and the two exchangers will have extensive dissuasive parking to attract the users of the towns not near to the river and so avoid the pressure in the interior of the capital. The boats will not have to cross the lock (this will represent an inacceptable delay), not either the north buffer, simply the users will have to change the line, changing boats. These lines will be in a distance of only some meters. The change will take place under cover, inside the two exchangers in less than one minute. The system VTS, AIS, and the communications TETRA have been designed to be shared with the commercial harbor of Seville with the aim of facilitating and coordinating the operations of both entities.

The invention claimed is:

1. An urban and interurban transport system for passengers using fluvial and maritime lanes, in which participate existing communication lanes including rivers and seas, comprising:

a closed building including a top ramp portion extending over a body of water;

a column extending upwardly from a support base formed at least partially above a surface of the body of water, wherein the column contacts the top ramp portion so as to define a docking point;

a floating quay associated with the closed building, wherein the floating quay is accessed from a series of articulated downwardly descending ramps inside the closed building, wherein the floating quay adapts to an existing water level of the body of water;

an exchange station that is provided for an exchange of the passengers in the closed building;

wherein the exchange station includes an area for access and cancellation of tickets through a corresponding ticket processing device;

a boat, wherein the boat is operable to access the docking point adjacent to the floating quay;

wherein the floating quay is closed or opened through a plurality of automatic doors corresponding in position with an access door provided in a port side or a starboard side of the boat; and an automatic docking system including a hydraulic ramp provided on the port side or the starboard side of the boat, that, when inoperative, remains in a vertical position and, when in a docking disposition, folds downwardly to a horizontal position, covering any required distance between the floating quay and the boat, wherein the hydraulic ramp, when in the horizontal position, extends over at least a portion of the floating quay.

2. The urban and interurban transport system according to claim 1, wherein the hydraulic platform is one meter high and of a same length as the access door of the boat, wherein the hydraulic platform is anchored to the boat at an inferior part, assisted by several hydraulic arms, having a structural reinforcement as a base platform of the boat.

* * * * *